US006755492B1

(12) United States Patent
Hyde et al.

(10) Patent No.: US 6,755,492 B1
(45) Date of Patent: Jun. 29, 2004

(54) SLIDING CABINET

(76) Inventors: Don W. Hyde, P.O. Box 305, Heber City, UT (US) 84032; Penny Hyde, P.O. Box 305, Heber City, UT (US) 84032

( * ) Notice: Subject to any disclaimer, the term of this patent is extended or adjusted under 35 U.S.C. 154(b) by 97 days.

(21) Appl. No.: 10/255,810

(22) Filed: Sep. 25, 2002

(51) Int. Cl.[7] ..... A47F 5/08
(52) U.S. Cl. ..... 312/247; 312/298
(58) Field of Search ..... 312/242, 245, 312/246, 247, 200, 294, 298, 308, 309, 301, 312

(56) References Cited

U.S. PATENT DOCUMENTS

| | | | | | |
|---|---|---|---|---|---|
| 628,828 | A | * | 7/1899 | Mentzer | 312/247 |
| 835,157 | A | * | 11/1906 | Fry | 312/247 |
| 3,415,586 | A | * | 12/1968 | Hammond | 312/312 |
| 3,650,591 | A | * | 3/1972 | Longmire, Sr. | 312/312 |

FOREIGN PATENT DOCUMENTS

| | | | | |
|---|---|---|---|---|
| DE | 2344640 | * | 3/1975 | 312/247 |
| DE | 2611661 | * | 3/1977 | 312/246 |
| FR | 2382872 | * | 10/1978 | 312/247 |

* cited by examiner

*Primary Examiner*—James O. Hansen

(57) ABSTRACT

A sliding cabinet that provides safe, ergonomic, and convenient access to shelves in elevated cabinets. The sliding cabinet comprises an inner cabinet and an outer cabinet housed by a support frame. In operation, the outer cabinet pulls out of the support frame by rolling horizontally on a roller and track system. Next, the inner cabinet lowers through the bottom of the outer cabinet by rolling vertically on a second roller and track system. After reaching a desired item, the inner cabinet can be raised back into the outer cabinet. Next, the outer cabinet is pushed back into the support frame for further storage. The sliding cabinet's components may be sized to fit into any size or style of cabinetry. Furthermore, the sliding cabinet is supplied with an adjustable counterweight, allowing the inner cabinet to be easily raised or lowered regardless of the weight on the shelves.

20 Claims, 5 Drawing Sheets

SLIDING CABINET

BACKGROUND OF THE INVENTION

1. Field of the Invention

The present invention relates to a sliding cabinet for use in connection with storing goods on elevated shelves. The sliding cabinet has particular utility in connection with providing safe, ergonomic, and convenient access to shelves in elevated cabinets.

2. Description of the Prior Art

Cabinets of varying size are widely employed as space savers in homes, garages, and businesses. The use of elevated cabinets is an extremely efficient space saving technique. However, not everyone can safely reach the shelves of elevated cabinets. For example, a person may drop an item while stretching to remove it from the top shelf of an elevated storage cabinet. As a result, the item may break or injure the person. In response to the hazards of removing items from elevated cabinets, mechanical cabinets have first been developed in the art. However, the mechanical cabinets present in the art are complicated and expensive to manufacture and install.

As stated, the use of mechanical cabinets is known in the prior art. For example, U.S. Pat. No. 3,415,586 to James F. Hammond discloses a cabinet shelf elevator and control. However, the Hammond '586 patent requires a motor to lower and raise the cabinet. The use of a motor introduces several drawbacks. First, motors are expensive, loud, and require maintenance. Second, the space required for a motor may preclude retrofitting the cabinet shelf elevator into existing cabinets.

Similarly, U.S. Pat. No. 3,650,591 to Ernest B. Longmire discloses a elevator shelf unit that lifts shelves through an opening in the top of a cabinet. The Longmire '591 patent utilizes a rod to lift and support the cabinet's shelves. However, a drawback of using the rod is a lack of support and stability for heavier items. For example, the rod may sway or collapse while supporting heavier items, causing the items to fall from the shelf and break.

While the above-described devices fulfill their respective, particular objectives and requirements, the aforementioned patents do not describe a sliding cabinet that allows safe, ergonomic, and convenient access to shelves in elevated cabinets. The Hammond '586 shelf elevator is neither ergonomic nor convenient. The shelf elevator requires a motor that is loud and precludes retrofitting in existing cabinets. Moreover, the Longmire '591 elevator shelf is unsafe because its only basis of supporting weight on the shelves is a single rod. However, the sliding cabinet of the present invention overcomes these drawbacks. The sliding cabinet requires no loud, space filling motor. Furthermore, the sliding cabinet employs ample support for the weight on its shelves.

Therefore, a need exists for a new and improved sliding cabinet that can be used for safe, ergonomic, and convenient access to shelves in elevated cabinets. In this regard, the present invention substantially fulfills this need. In this respect, the sliding cabinet according to the present invention substantially departs from the conventional concepts and designs of the prior art, and in doing so provides an apparatus primarily developed for the purpose of allowing safe, ergonomic, and convenient access to shelves in elevated cabinets.

SUMMARY OF THE INVENTION

In view of the foregoing disadvantages inherent in the known types of mechanical cabinets now present in the prior art, the present invention provides an improved sliding cabinet, and overcomes the above-mentioned disadvantages and drawbacks of the prior art. As such, the general purpose of the present invention, which will be described subsequently in greater detail, is to provide a new and improved sliding cabinet which has all the advantages of the prior art mentioned heretofore and many novel features that result in a sliding cabinet which is not anticipated, rendered obvious, suggested, or even implied by the prior art, either alone or in any combination thereof.

To attain this, the present invention essentially comprises a sliding cabinet with an inner cabinet and outer cabinet that connect to a support frame. The outer cabinet pulls out of the support frame by rolling horizontally on a roller and track system. Once the outer cabinet is free of the support frame, the inner cabinet lowers through the bottom of the outer cabinet by rolling vertically on a second roller and track system. After reaching the desired item, the inner cabinet is raised back into the outer cabinet and the outer cabinet is pushed back into the support frame. Additionally, the sliding cabinet is supplied with an adjustable counterweight, allowing the inner cabinet to be easily raised or lowered regardless of the weight on the shelves. Moreover, the components may be sized to fit into any size or style of cabinetry.

There has thus been outlined, rather broadly, the more important features of the invention in order that the detailed description thereof that follows may be better understood and in order that the present contribution to the art may be better appreciated.

The invention may also include door that covers the sliding cabinet while it positioned in the support frame. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sliding cabinet that has all of the advantages of the prior art mechanical cabinets and none of the disadvantages.

It is another object of the present invention to provide a new and improved sliding cabinet that may be easily and efficiently manufactured and marketed.

An even further object of the present invention is to provide a new and improved sliding cabinet that has a low cost of manufacture with regard to both materials and labor, and which accordingly is then susceptible of low prices of sale to the consuming public, thereby making such sliding cabinet economically available to the buying public.

Still another object of the present invention is to provide a new sliding cabinet that provides a safe and ergonomic storage alternative.

Lastly, it is an object of the present invention to provide a new and improved sliding cabinet has a stable support mechanism and does not require a motor.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
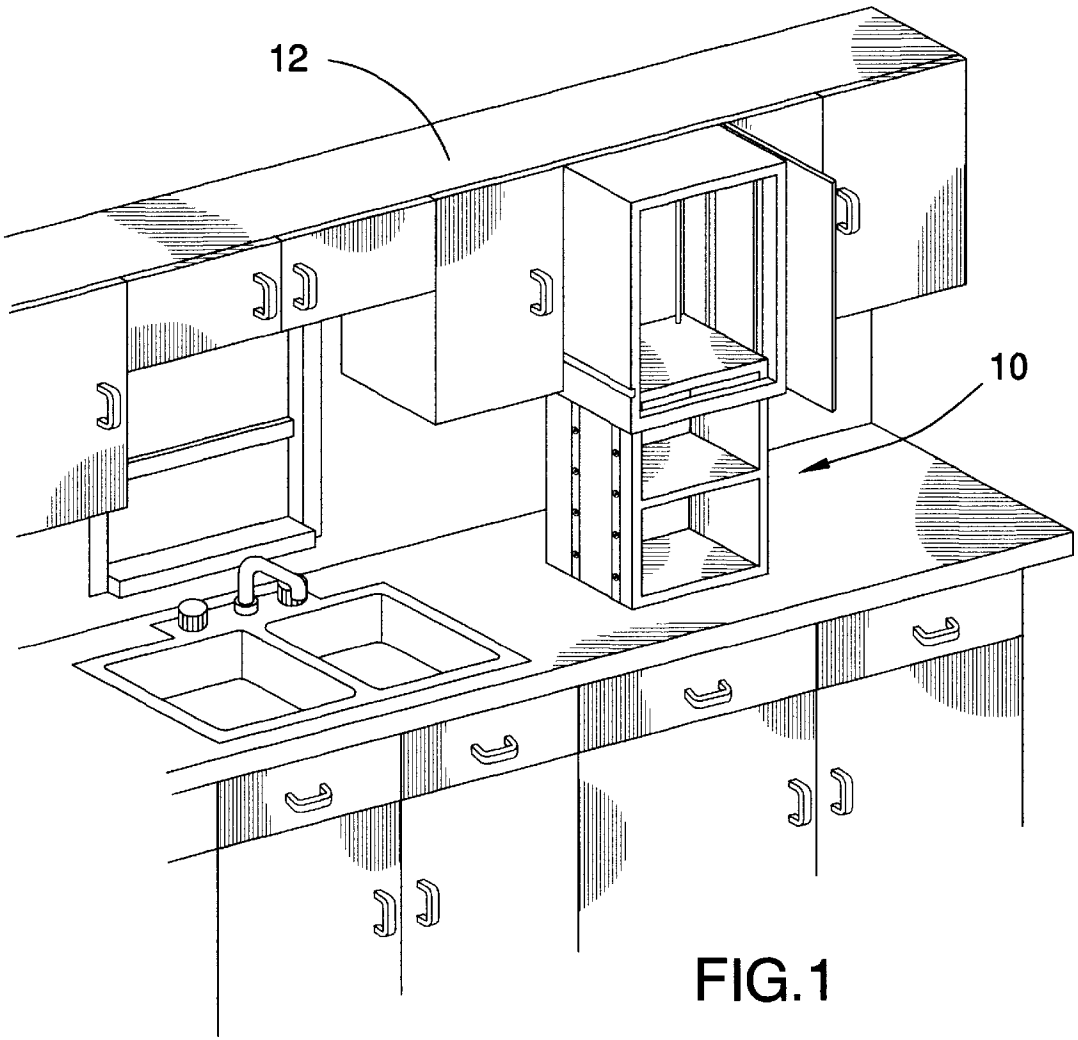
FIG. 1 is a front perspective view of the preferred embodiment of the sliding cabinet in its down position.

Referring now to the drawings, and particularly to FIGS. 1–5, a preferred embodiment of the sliding cabinet of the present invention is shown and generally designated by the reference numeral 10.

Figure 2:
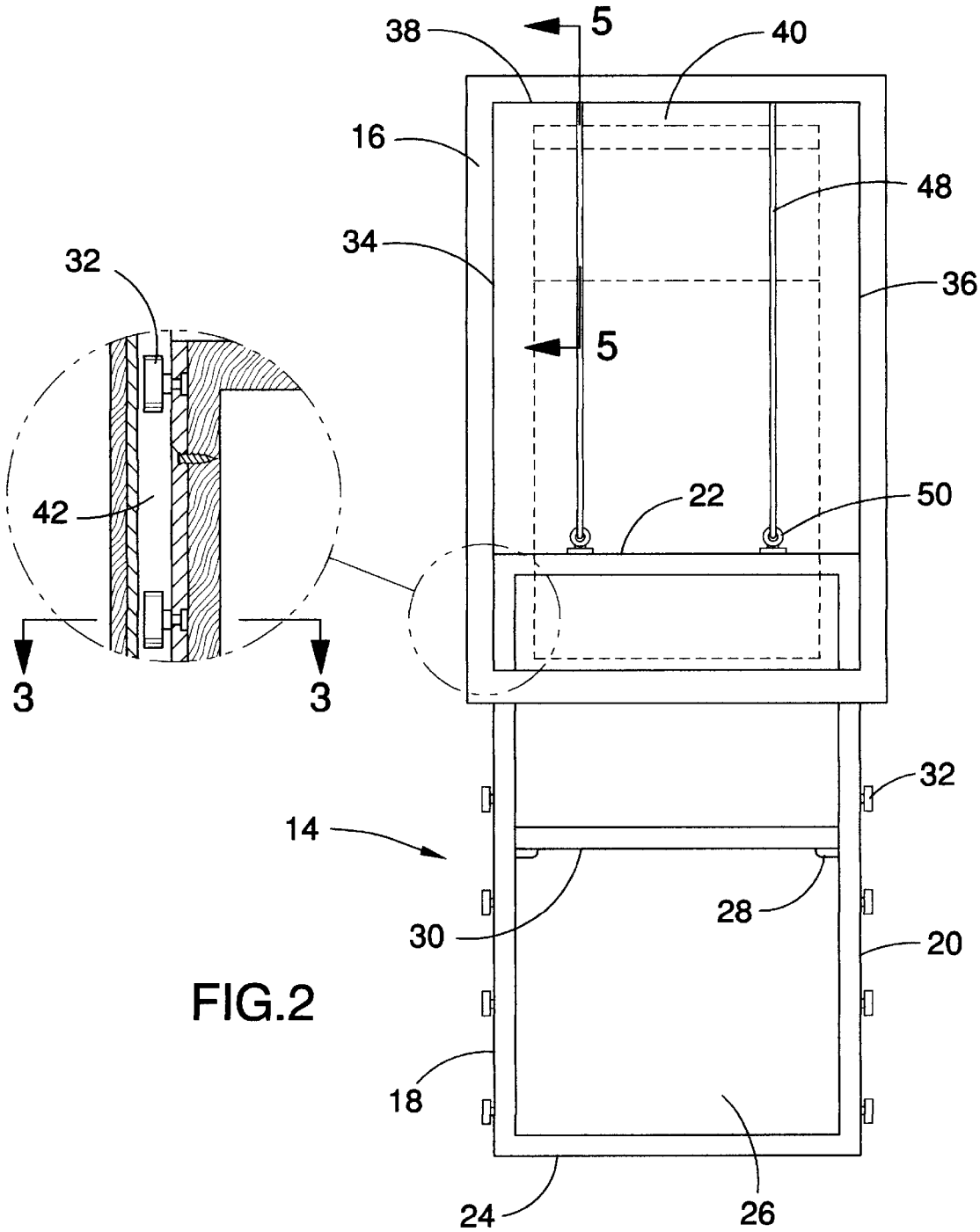
FIG. 2 is a front elevational view of the sliding cabinet of the present invention with a sectional view of the vertical roller and track system.

In FIG. 1, a new and improved sliding cabinet 10 of the present invention for providing safe, ergonomic, and convenient access to shelves in elevated cabinets is illustrated and will be described. A support frame 12 houses the sliding cabinet 10. The support frame 12 is similar to a hollowed out conventional cabinet, having a three side walls, a top wall, and a bottom wall. As FIG. 3 more particularly illustrates, the sliding cabinet 10 has a inner cabinet 14 and an outer cabinet 16 that fit inside the support frame 12. As FIG. 2 illustrates, the inner cabinet 14 may be lowered and raised from the outer cabinet 16.

The inner cabinet 14 comprises a left wall 18 and a right wall 20 parallel to the left wall 18. Furthermore, the inner cabinet 14 has a top wall 22 and a bottom wall 24 that run parallel, connecting the left wall 18 and right wall 20 at opposite ends. In addition, the inner cabinet has a back wall 26 that is fixed to the left 18, right 20, top 22, and bottom 24 walls. A plurality of plastic brackets 28 are movably fixed on the inside of the left 18 and right 20 inner cabinet walls. Each bracket 28 on the left wall 18 has a counterpart bracket 28 located directly across from it on the right wall 20. The inner cabinet's brackets 28 support a plurality of shelves 30. In the preferred embodiment, the walls of the inner cabinet 14 are made of wood. Likewise, the shelves 30 are wooden.

A plurality of vertically aligned rollers 32 are fixed to the outside of the inner cabinet's left 18 and right 20 walls. Each roller 32 rotates on its axis. In the preferred embodiment, the vertically aligned rollers 32 are made of a hard, durable plastic.

The outer cabinet 16 comprises a left wall 34 and a right wall 36 parallel to the left wall 34. Furthermore, the outer cabinet 16 has a top wall 38 that runs perpendicular to the left 34 and right 36 walls, connecting them at one end. In addition, the outer cabinet has a back wall 40, fixed to the left 34, right 36, and top 38 walls.

Figure 4:
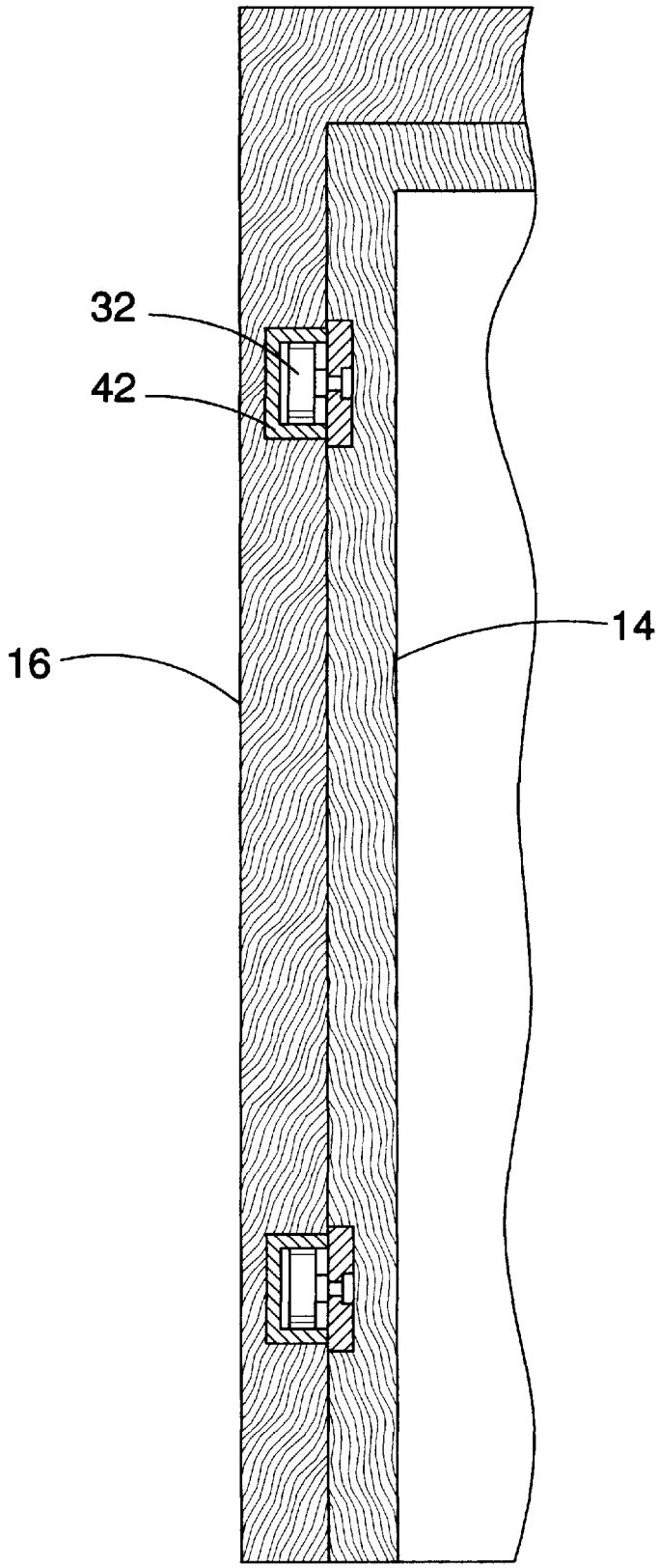
FIG. 4 is a cross-sectional view of the sliding cabinet's vertical roller and track system.
Figure 5:
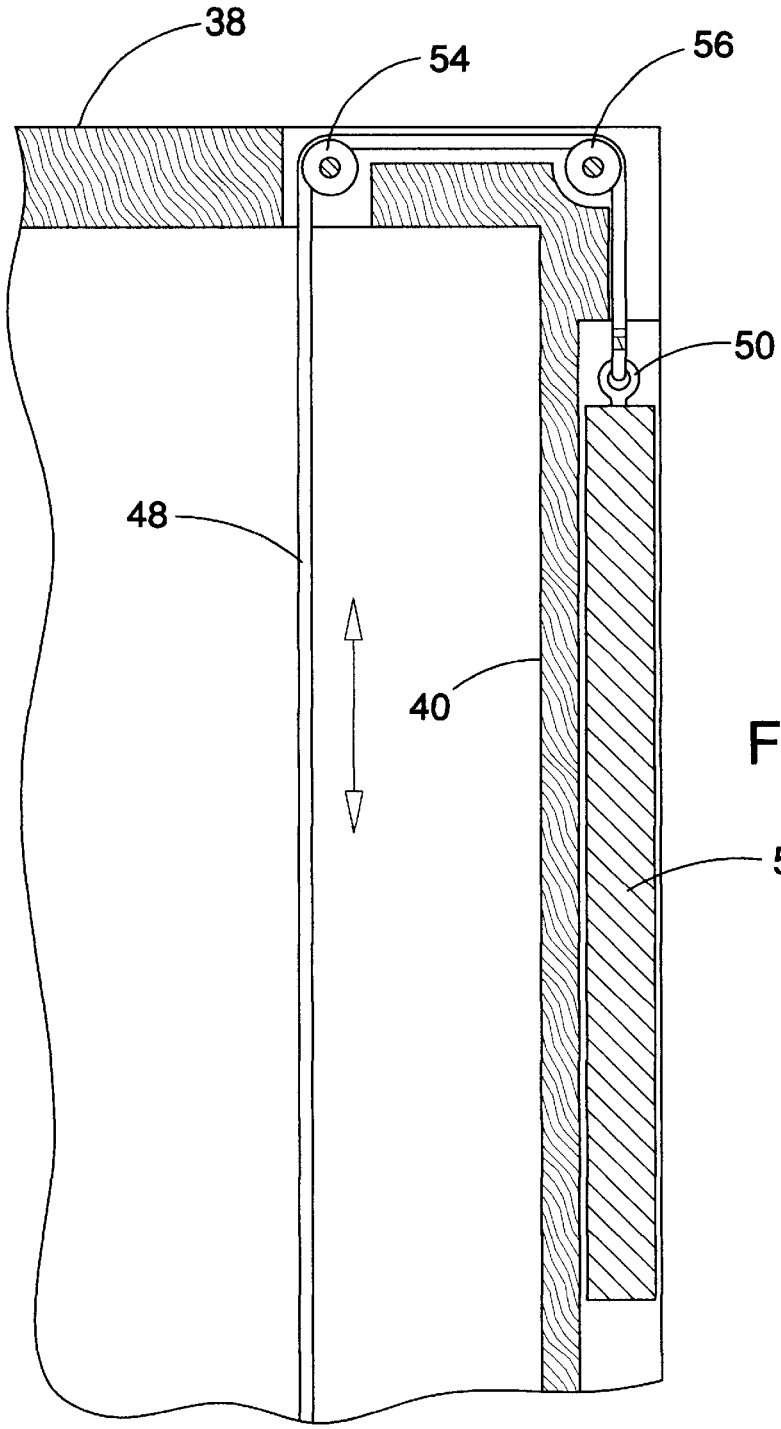
FIG. 5 is a sectional view of the sliding cabinet's pulley and counterweight system. The same reference numerals refer to the same parts throughout the various figures.

A set of vertical tracks 42 are attached to the inside of the outer cabinet's left 34 and right 36 walls. Each track 42 is shaped and dimensioned to allow engagement with the vertically aligned rollers 32 and slidable movement of the vertically aligned rollers 32 within the vertical track 42. FIG. 4 is a cross-sectional view of the sliding cabinet's vertically aligned rollers 32 and vertical tracks 42. In the preferred embodiment, the vertical tracks 42 are made of a hard, durable plastic.

Figure 3:
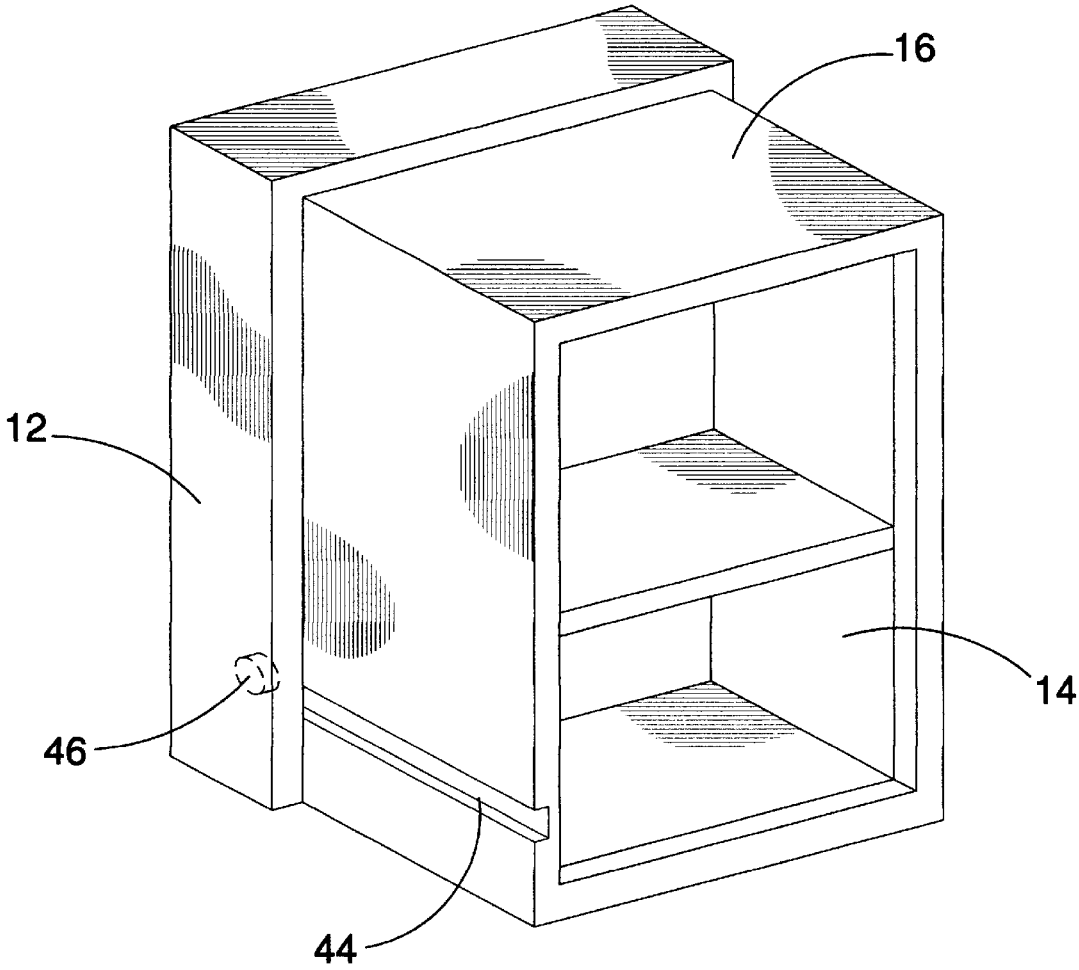
FIG. 3 is a left perspective view of the outer cabinet pulled out of the support frame with a sectional view of the horizontal roller and track system.

As FIG. 3 illustrates, a set of horizontal tracks 44 are attached to the outside of the outer cabinet's left 34 and right 36 walls. Specifically, one horizontal track 44 is located near the bottom of the outer cabinet's left wall 34 and the second horizontal track 44 is located on the bottom of the outer cabinet's right wall 36. The horizontal tracks 44 run parallel to each other from the outer cabinet's back wall 40 to the front of the outer cabinet 16.

As FIG. 3 further illustrates, a set of plastic horizontal rollers 46 is fixed to the inside of the support frame 12. Each horizontal roller 46 is shaped and dimensioned to engage the outer cabinet's horizontal tracks 44, allowing the outer cabinet 16 to slide in and out of the support frame 12.

As illustrated in FIG. 2, a plurality of counterweight cables 48 are attached to the inner cabinet's top wall 22 with eye screws 50. As better illustrated by FIG. 5, the opposite end of each counterweight cable 48 is attached to a counterweight 52 with an eye screw 50. The counterweight 52 is adjustable to allow for more or less weight on the shelves 30. A series of pulleys, comprising a cabinet pulley 54 and a counterweight pulley 56, supports and balances the weight distribution of the inner cabinet 14 and the counterweight 52. The cabinet pulley 54 is fixed to the outer cabinet's top wall 36 directly over the eye screws 50 connecting the counterweight cable 48 to the inner cabinet's top wall 36. The counterweight pulley 56 is fixed to the outer cabinet's top wall 36 near the intersection of the outer cabinet's top wall 36 with its back wall 40. The counterweight cable 48 runs over the cabinet pulley 54 and the counterweight pulley 56. In the preferred embodiment the counterweight cables 48 are constructed of rubber-coated cable. Moreover the length of the counterweight cables 48 is sufficient to lower the inner cabinet 14 to a desired level.

In operation, the outer cabinet 16 pulls out of the support frame 12 by moving the horizontal tracks 44 across the horizontal rollers 46. Next, the inner cabinet 14 lowers through the bottom of the outer cabinet 16 by moving the vertically aligned rollers 32 through the vertical tracks 42. After reaching a desired item, the counterweight 52 allows the inner cabinet 14 to be easily returned to its elevated position. Once the inner cabinet 14 is inside the outer cabinet 16, the outer cabinet 16 slides back into the support frame 12. The components may be sized to fit into any size or style of cabinetry. Furthermore, the sliding cabinet 10 is supplied with an adjustable counterweight 52, allowing the inner cabinet 14 to be easily raised or lowered regardless of the weight on the shelves 30.

While a preferred embodiment of the sliding cabinets has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, plastic, cardboard, or a variety of wood may be used to construct the inner and outer cabinets. Also, the plastic rollers and tracks may be made of metal or wood. The counterweight cables may be constructed of any rubber, wire, or rope-like material. Additionally, with exception of the counterweight cables, each component of the sliding cabinet may be constructed of molded plastic.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A sliding cabinet comprising:

a support frame having a left wall and a right wall, said left wall aligned parallel to said right wall;

an outer cabinet having a left wall, a right wall parallel to said left wall, and a top wall perpendicular to said left and right walls;

an inner cabinet having a left wall, a right wall parallel to said left wall, and a top wall perpendicular to said left and right walls;

a plurality of shelves movably fixed to the inside of the inner cabinet's left and right walls;

a set of vertical tracks, a first vertical track attached to the inside of the outer cabinet's left wall and a second vertical track attached to the inside of the outer cabinet's right wall;

a plurality of vertically aligned rollers attached to the outside of the inner cabinet's left and right walls, said vertically aligned rollers shaped and dimensioned for slidable movement in the vertical tracks;

a set of horizontal tracks, a first horizontal track attached to the outside of the outer cabinet's left wall and second horizontal track attached to the outside of the outer cabinet's right wall;

a set of horizontal rollers attached to the inside of the support frame's left and right walls, said horizontal rollers shaped and dimensioned for slidable movement in the horizontal tracks;

a counterweight;

a plurality of counterweight cables, said counterweight cables attached at one end to the counterweight and attached at another end to the outside of the inner cabinet's top wall; and a plurality of pulleys fixed to the outer cabinet's top wall, said pulleys shaped and dimensioned for movable support of the counterweight cables.

2. The sliding cabinet of claim 1 wherein said support frame further comprises a top wall perpendicular to said left and right walls, a bottom wall parallel to said top wall, and a back wall integrally connected to said left, right, top, and bottom walls.

3. The sliding cabinet of claim 2 wherein said outer-cabinet further comprises a back wall integrally connected to said left, right, and top walls.

4. The sliding cabinet of claim 3 wherein said inner cabinet further comprises a bottom wall parallel to said top wall, and a back wall integrally connected to said left, right, top, and bottom walls.

5. The sliding cabinet of claim 4 further comprising:

a cabinet door hinged to the support frame.

6. The sliding cabinet of claim 5 wherein said counterweight comprises a plurality of adjustable weights.

7. The sliding cabinet of claim 6 wherein the outer cabinet, inner cabinet, shelves, vertical tracks, vertically aligned rollers, horizontal tracks, horizontal rollers, and pulleys are constructed of molded plastic.

8. The sliding cabinet of claim 6 wherein the outer cabinet, inner cabinet, and shelves are constructed of wood.

9. A sliding cabinet comprising:

a support frame, having a left wall, a right wall parallel to the left wall, a top wall perpendicular to the left and right walls, a bottom wall parallel to the top wall, and back wall connected to the left, right, top, and bottom walls, said support frame walls being integrally attached;

a cabinet door hinged to said support frame;

an outer cabinet, having a left wall, a right wall parallel to the left wall, a top wall perpendicular to the left and right walls, and a back wall connected to left, right, and top walls, said outer cabinet walls being integrally attached;

an inner cabinet, having a left wall, a right wall parallel to the left wall, a top wall perpendicular to the left and right walls, a bottom wall parallel to the top wall, and a back wall connected to the left, right, top, and bottom walls, said inner cabinet walls being integrally attached;

a plurality of brackets movably fixed to the inside of the inner cabinet's left and right walls;

a plurality of shelves horizontally supported by the brackets;

a set of vertical tracks, a first vertical track attached to the inside of the outer cabinet's left wall and a second vertical track attached to the inside of the outer cabinet's right wall;

a plurality of vertically aligned rollers attached to the outside of the inner cabinet's left and right walls, said vertically aligned rollers shaped and dimensioned for slidable movement in the vertical tracks;

a set of horizontal tracks, a first horizontal track attached to the outside of the outer cabinet's left wall and second horizontal track attached to the outside of the outer cabinet's right wall;

a set of horizontal rollers attached to the inside of the support frame's left and right walls, said horizontal rollers shaped and dimensioned for slidable movement in the horizontal tracks;

a counterweight;

a plurality of counterweight cables, said counterweight cables attached at one end to the counterweight and attached at another end to the outside of the inner cabinet's top wall;

a plurality of cabinet pulleys fixed to the outer cabinet's top wall directly above the end of the counterweight cable attached to the inner cabinet's top wall, said pulleys shaped and dimensioned for movable support of the counterweight cables; and a plurality of counterweight pulleys fixed to the outer cabinet's top wall directly above the end of the counterweight cable attached to the counterweight, said pulleys shaped and dimensioned for movable support of the counterweight cables.

10. The sliding cabinet of claim 9 wherein the outer cabinet, inner cabinet, shelves, vertical tracks, vertically aligned rollers, horizontal tracks, horizontal rollers, and pulleys are constructed of molded plastic.

11. The sliding cabinet of claim 9 wherein the outer cabinet, inner cabinet, and shelves are constructed of wood.

12. A sliding cabinet comprising:

a support frame having a left wall and a right wall, said left wall aligned parallel to said right wall;

an outer cabinet having a left wall, a right wall parallel to said left wall, and a top wall perpendicular to said left and right walls;

an inner cabinet having a left wall, a right wall parallel to said left wall, and a top wall perpendicular to said left and right walls;

a plurality of shelves movably fixed to the inside of the inner cabinet's left and right walls;

a set of vertical tracks, a first vertical track attached to the inside of the outer cabinet's left wall and a second vertical track attached to the inside of the outer cabinet's right wall;

a plurality of vertically aligned rollers attached to the outside of the inner cabinet's left and right walls, said vertically aligned rollers shaped and dimensioned for slidable movement in the vertical tracks;

a set of horizontal tracks, a first horizontal track attached to the outside of the outer cabinet's left wall and second horizontal track attached to the outside of the outer cabinet's right wall; and a set of horizontal rollers attached to the inside of the support frame's left and right walls, said horizontal rollers shaped and dimensioned for slidable movement in the horizontal tracks.

13. The sliding cabinet of claim 12 further comprising:

a plurality of brackets movably fixed to the inside of the inner cabinet's left and right walls, wherein said brackets horizontally support said plurality of shelves.

14. The sliding cabinet of claim 13 wherein said support frame further comprises a top wall perpendicular to said left and right walls, a bottom wall parallel to said top wall, and a back wall integrally connected to said left, right, top, and bottom walls.

15. The sliding cabinet of claim 14 wherein said outer cabinet further comprises a back wall integrally connected to said left, right, and top walls.

16. The sliding cabinet of claim 15 wherein said inner cabinet further comprises a bottom wall parallel to said top wall, and a back wall integrally connected to said left, right, top, and bottom walls.

17. The sliding cabinet of claim 16 further comprising:

a cabinet door hinged to the support frame.

18. The sliding cabinet of claim 17 wherein the outer cabinet, inner cabinet, and shelves are constructed of metal.

19. The sliding cabinet of claim 17 wherein the outer cabinet, inner cabinet, shelves, vertical tracks, vertically aligned rollers, horizontal tracks, horizontal rollers, and pulleys are constructed of molded plastic.

20. The sliding cabinet of claim 17 wherein the outer cabinet, inner cabinet, and shelves are constructed of wood.

* * * * *